United States Patent [19]

Kunz

[11] 4,057,053

[45] Nov. 8, 1977

[54] FOOT BATH MASSAGER

[75] Inventor: Raymond W. Kunz, Monroe, Conn.

[73] Assignee: Clairol Incorporated, New York, N.Y.

[21] Appl. No.: 683,129

[22] Filed: May 4, 1976

[51] Int. Cl.[2] ..... A47K 3/10; A61H 9/00

[52] U.S. Cl. ..... 128/25 B; 128/33; 128/65; 4/182

[58] Field of Search ..... 128/24.1, 25 B, 33, 128/24.2, 65; 4/182, 178

[56] References Cited

U.S. PATENT DOCUMENTS

| | | | |
|---|---|---|---|
| 2,904,037 | 9/1959 | Cassidy | 128/66 |
| 3,043,294 | 7/1962 | Neff | 128/25 B |
| 3,055,357 | 9/1962 | Redka | 128/25 B |
| 3,366,105 | 1/1968 | Sadowski et al. | 128/24.1 |
| 3,830,232 | 8/1974 | McNair | 128/33 |
| 3,881,471 | 5/1975 | Grube | 128/65 |
| 3,885,555 | 5/1975 | Nobbs | 128/25 B |
| 3,942,520 | 3/1976 | McNair | 128/24.1 |
| 3,965,495 | 6/1976 | McNair | 4/182 |

*Primary Examiner*—Aldrich F. Medbery
*Attorney, Agent, or Firm*—David J. Mugford; George A. Mentis; Samuel J. DuBoff

[57] ABSTRACT

A foot massager and bath is disclosed in which either a massage or a heated bath or both are optionally available to the user. The bath is maintained in temperature by an element protruded through the wall of the unit to provide a metal-to-bath heat exchange and is shielded from the user's feet by a grille portion of the unit. A vibrating massage is provided by an electrical vibrator mounted on a plane above the plane of the deck upon which the feet are rested and which is coupled to the deck at a point substantially below the foot plane to provide a variable-direction motion of the foot plane area and a consequent variation in the vibrations imparted to the feet. A variable-capacity mount is disclosed which supports the unit on a surface by means of a variable-contoured elastomeric support under differing weight circumstances to provide increased stiffness in the support to accommodate an increased load from within the unit.

13 Claims, 7 Drawing Figures

FOOT BATH MASSAGER

BACKGROUND OF THE INVENTION

The present invention relates to foot care and is concerned, more particularly, with the vibration-massage and bathing of the feet in a portable, self-contained unit.

BRIEF DISCUSSION OF THE PRIOR ART

Various attempts have been made to provide foot-care massagers and baths which are portable and which are capable of convenient storage in between periods of use. These prior units have included those which provide a vibrating massage alone, a vibrating massage with dry heat, or a vibrating massage with a liquid bath and a supplemental heater.

Simple vibrating units are capable of providing a degree of mechanical stimulation to the feet. However, such units not only lack the soothing effect of a warm bath but also are capable of providing only an essentially constant vibration of uniform direction and amplitude, so that the effect of the vibrations thus imparted is only moderately successful in terms of an actual massage effect.

Even when such vibrating units are provided with dry heating means, the essential nature of the vibration is not altered, so that the massage effect remains quite limited in spite of the additional, soothing effect of the heater.

In cases in which vibration effects have been joined with a bathing effect and, particularly, with a heated bath, the sensation provided to the feet is considerably improved in its comforting and relieving action.

However, such prior, heated-bath vibrating units have been less than convenient in the nature of use and trouble of handling which they impose on the user. One form of such unit, in commendable concern for the hazards of electrical shock, provides for separable components which necessarily must be broken down for filling of the bath and then re-assembled for use. Emptying and removal of the unit to storage requires a similar handling of the unit and attendant concern to avoid misplacement or loss of one of the components such as, for example, a clip-on, immersion-type heating rod. Such immersion heaters, however, provide a burn hazard to the user which is in direct proportion to their efficiency of transfer of heat to the bath. Therefore, such units not only are clumsy to use and to store and potentially painful if accidentally misused, but also retain the limited vibrational effect which is typical of uniform-direction vibrations.

Furthermore, the vibrations imparted to such baths typically have been applied directly to an endwall of the bath or, in the case of one separable-component unit, indirectly through the walls of the vibrating base and of the bath-holding tank. The attendant loss of efficiency in transferring the vibrations to the feet further reduces the effect of the vibrations and even further removes the net effect upon the feet from the real massaging effect which would be most desireable.

Other undesireable consequences of the prior forms of foot-treating units include that of a tendency of the liquid of the bath to splash out of the container during transport and during use of the bath and that of the tendency of such units to walk or to migrate along the surface upon which they are rested for use. In certain circumstances, these two problems can aggravate each other in that a mount which permits motion of the bath vessel will permit substantial motion of the body of liquid and a consequently increased potential for splashing. Increased motion or sloshing of the liquid body also complicates the problem of a secure, non-walking positioning of the unit while it is in use.

Prior units have included attempts to provide splash guarding about the bath vessel and relatively positive mounts, such as suction cups, for the base of the unit. However, if the suction cups are effective in tying-down the unit during its use, they complicate the problem by their substantial resistance to removal of the liquid-filled unit from the surface against which the cups are secured by their suction. The consequence can be that of splashing or even substantial spillage of the bath.

Therefore, the prior attempts at providing an effective combination of vibration and a heated bath for foot care have not been found to be entirely satisfactory.

SUMMARY OF THE INVENTION

In general, the preferred form of the present invention comprises a basin having a central tunnel intermediate the areas upon which the feet are rested, the tunnel having a vertically enlarged portion for mounting a control switch at an elevated level and for receiving a vibrating unit therein in a position sufficiently spaced from the walls of the enlarged portion to permit substantial motion of the vibrating unit in relation to the basin. The vibrating unit is coupled to the foot-rest areas at a level below the plane upon which the feet rest by pairs of coupling mounts which are spaced from each other along the length of the foot area. The tunnel includes an aperture for receiving a heater into the interior of the basin for delivering heat to the bath zone. The heater is shielded from foot contact by a guard which is spaced therefrom to permit direct contact of the bath with the heater.

The basin is supported on a plurality of resilient discs which are deformed by their mounts into a generally conical form and which present increased stiffness in the support by means of a variable-contoured elastomeric support which provides increased areas of frictional contact under conditions of increased load from within the unit.

OBJECTS OF THE INVENTION

It is an object of the present invention to provide a simple and convenient, massaging bath for the feet.

It is another object of the present invention to provide a foot bath unit for warm bathing of the feet and for massaging the feet with varying vibrations.

It is a further object of the present invention to provide a foot bath unit which massages the feet by means of vibrations which are imparted to the feet at varying angles in relation to the original rest position of the feet in the unit.

A further object of the present invention is the provision of a foot-treating unit which includes a vibrator which is mechanically coupled to the foot-rest area of the unit and which imparts varying vibrations to the foot-rest area.

A still further object of the present invention is the provision of a foot-treating unit which includes an eccentricweight vibrator which is positioned above the foot-rest area and which is coupled to the foot-rest portion of the deck at a level beneath the foot-rest area.

Another object of the present invention is the provision of a foot-treating unit which includes a vibrator having its vibration-producing means at a level substantially above the level of engagement of the feet by the deck and which is coupled to the deck at a level substantially below the level of engagement of the feet.

It is a particular object of the present invention to provide a foot bath unit which massages the feet by means of vibrations which are imparted to the feet at varying angles and which maintains an elevated temperature in the liquid of the bath.

It is a further and particular object of the present invention to provide a foot bath unit which massages the feet by means of a vibrator which is mounted for generally oscillating movement at a level substantially above the level of the foot deck and which is coupled to the foot deck at a level substantially below the foot level to impart varying vibrations to the feet at varying angles to the original rest position of the feet to cause a flexing of the feet in addition to the vibrating effect.

Another particular object of the present invention is the provision of a foot-treating unit which capable of selective treatment of the feet by dry, varying vibration, by immersion and varying vibration or by immersion, varying vibration and elevated temperatures.

BRIEF DESCRIPTION OF THE DRAWINGS

These and other objects of the invention, as well as a better understanding thereof, will be apparent from the following description and the accompanying drawings, in which.

DETAILED DESCRIPTION OF THE PREFERRED EMBODIMENT

Figures 1, 6, 7:
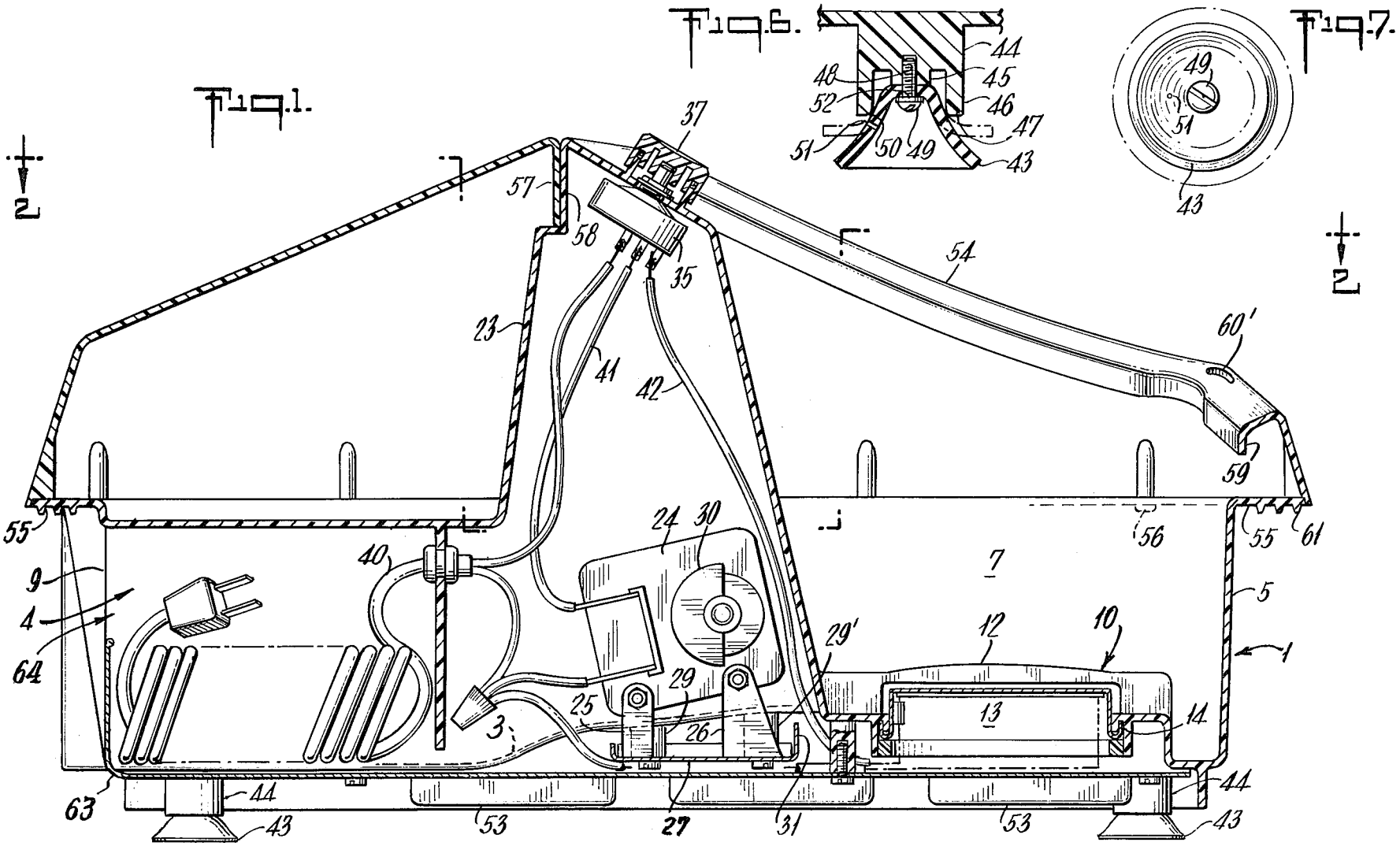
FIG. 1 is a sectional side elevation of the preferred unit of the present invention.
FIG. 6 is an enlarged, sectional view of the mounting foot and mount.
FIG. 7 is a schematic view showing the variable area of contact of the mount under differing loads.

As shown in the drawings, the preferred form of foot-treating unit of the present invention comprises a base member 1 having left and right deck areas 2 and 3, respectively and an intermediate tunnel 4. The base member is surrounded by a front wall 5, a pair of side walls 6 and 7 and a pair of rear end walls 8 and 9 which join with the decks and the tunnel in a manner forming a U-shaped basin about the central tunnel.

Preferably, the deck areas 2 and 3 are at least partially contoured to conform to the human foot, such as by provision of a raised arch-area and heel point, as best shown in FIG. 1. Intermediate the heel zones of the decks 2 and 3, the tunnel includes a lowered portion 10 having an aperture 11 therein and a plurality of overlying ridges 12 which form a grille within the U-shaped basin.

The aperture 11 receives an inverted cup 13 of aluminum or another, suitable metal and which has an upturned edge 14 about its periphery. The upturned edge 14 is received in a recess 15 in the underside of the tunnel wall and is secured therein in watertight relationship by a sealant 16 and a lock member 17 which secures the assembly by suitable means such as by weldment to the wall of the recess 15.

While the cup 13 is disclosed as being circular, it is to be understood that other shapes may be used, if desired. However, it is advantageous to have the cup extend a substantial distance beyond the aperture 11 and into the bath zone to provide for cooling of the cup wall by the liquid of the bath and a consequent protection of the watertight joint, at lip 14, from an excess of heat. Location of a heater strip 18 by lamination to the remote bottom wall 19 of the cup then permits location of a thermostatic control 20 at an intermediate point on the side wall 21 of the cup to limit the maximum temperature to which the watertight joint may be subjected. A fusible link 22 preferably is included for further protection of the unit.

Figure 2:
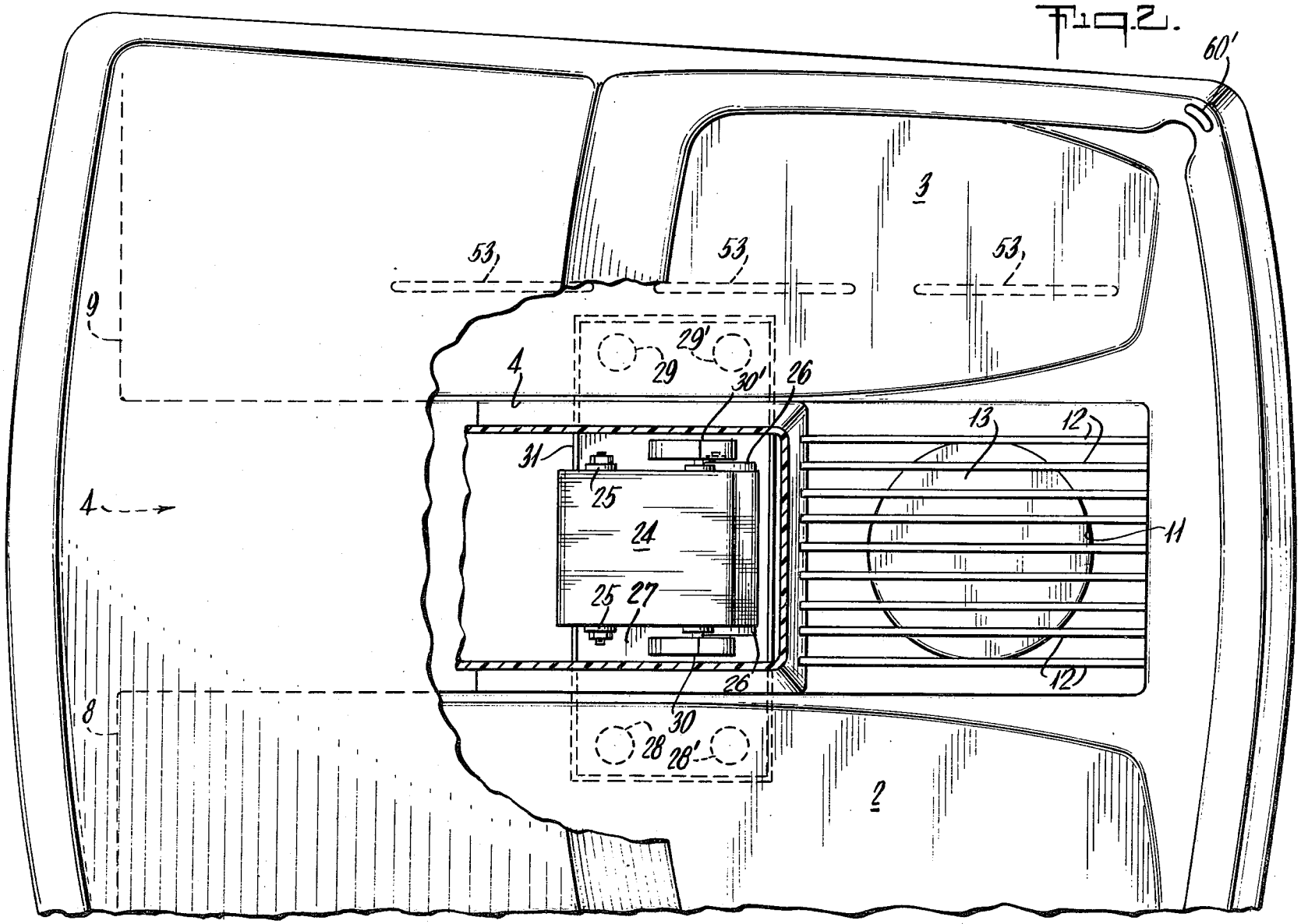
FIG. 2 is a plan view, partly cut away, of the unit of FIG. 1.
Figure 3:
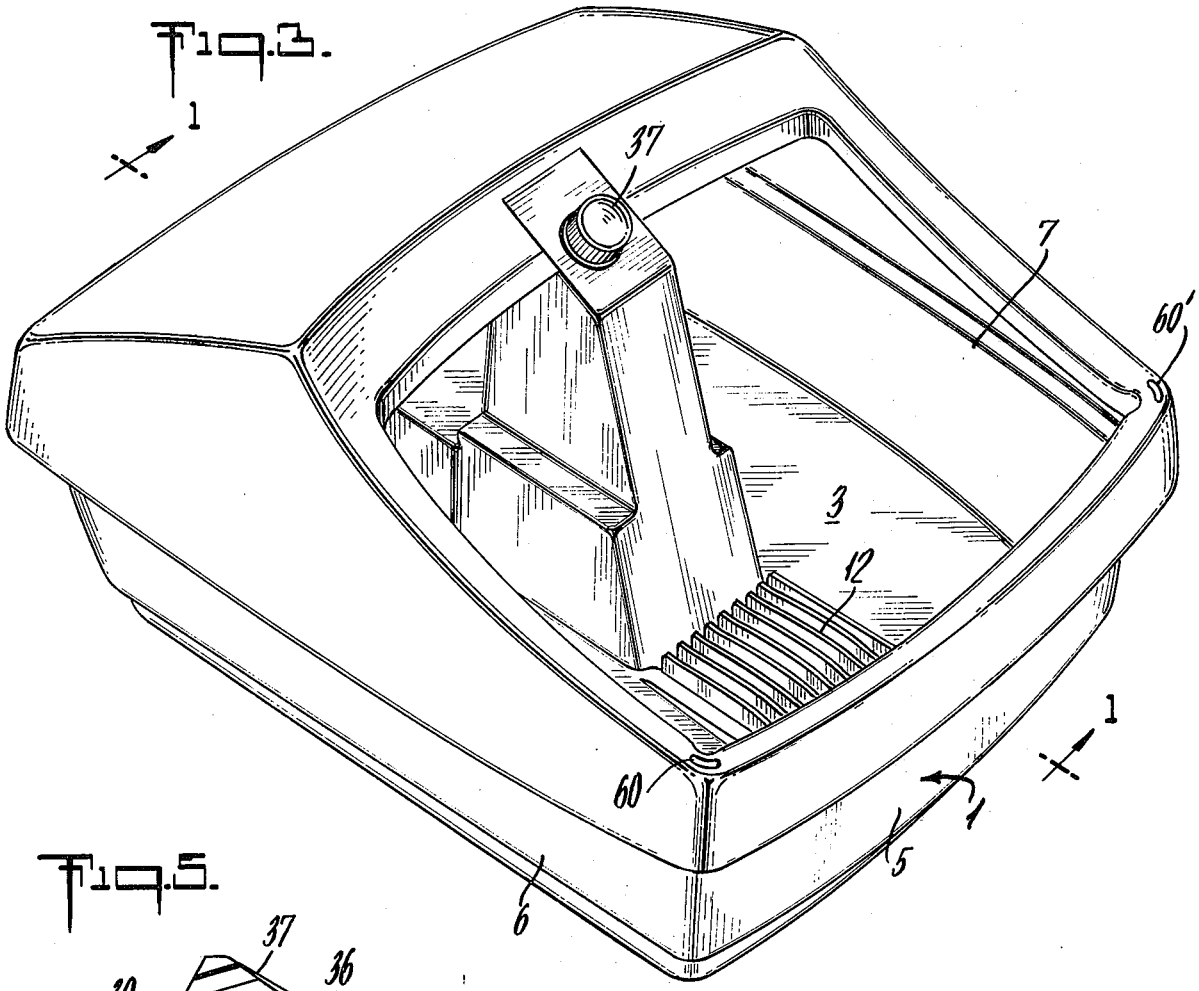
FIG. 3 is a perspective view of the unit.
Figure 5:
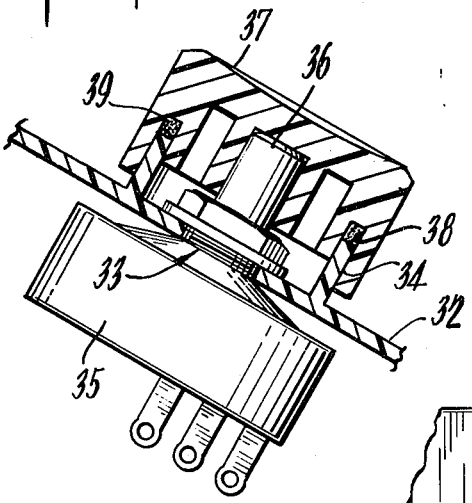
FIG. 5 is an enlarged view of another portion of FIG. 1 and showing the selector switch mounting.
Figure 4:
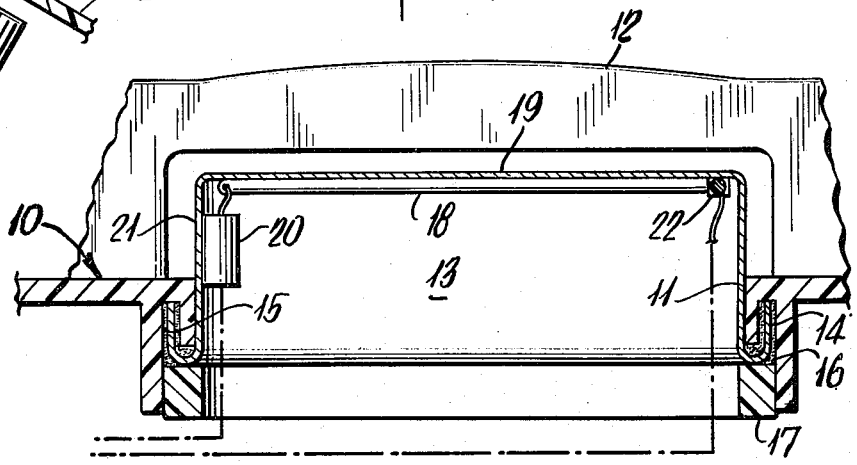
FIG. 4 is an enlarged view of a portion of FIG. 1 and showing the heater for the bath.

The central tunnel 4 includes a raised portion in the form of a pylon 23 in the zone generally intermediate the arch portions of the deck areas 2 and 3. Within its lower portion, the pylon 23 receives a vibrator unit 24 mounted on arms 25 and 26 of a frame 27 which is positioned at a level substantially below the plane of the deck areas. The frame 27 forms a beam which extends laterally to underly a portion of each of the deck areas and is coupled thereto by pairs of coupling bosses 28, 28' and 29, 29' which are spaced from the other of the pair along the longitudinal portion of the deck areas 2 and 3, respectively, as best shown in FIG. 2. This arrangement localizes the vibrations in the deck area.

The vibrator unit 24 thus is positioned at a level substantially above the plane of the decks 2 and 3 but is coupled to the decks at a level below the foot level. The difference in elevation thus provides a substantial lever arm from the point of vibration of the unit 24 to the point of coupling of the vibrations to the deck. This permits a degree of oscillation of vacillation of the vibrator unit which requires an adequate clearance from the interior walls of the pylon 23.

While the disclosed vibrator unit 24 includes the preferred vibration source of paired, eccentric weights 30 and 30', it is to be understood that other forms of vibrators may be employed. However, where such other forms are used, it is most advantageous to mount them in a manner which will provide at least a part of their energy in a direction transverse to the lever arm provided by the mounting and coupling thereof on opposite sides of the decks to provoke a degree of oscillation of the structure and to impart a rocking action to the decks, as will be discussed more fully hereinafter.

It is also preferable that the frame 27 be formed to transmit the torsional or oscillating force to the decks without substantial loss. It has been found to be advantageous to form the frame of a substantial thickness of metal and to provide stiffening in the form of upturned edges 31 which tend to resist distortion of the frame and a consequent attenuation of the oscillations. To further the efficiency of coupling of the vibrator unit with the decks, it is preferred that the coupling bosses be cast or molded as integral portions of the decks 2 and 3.

In its upper region, the pylon 23 has a slanted top wall 32 having an aperture 33 therein and a circular sleeve 34 extending upwardly therefrom concentrically about the aperture. A switch body 35 is suitably mounted on the wall 32 with its control arm 36 extending within the sleeve 34 to engage a switch knob 37. The switch knob 37 includes an annular recess 38 for receiving the sleeve 34 in a close, rotatable fit with a ring of thermally-stable sealing material 39 positioned in the bottom of the annular recess 38 to engage and seal against the upper edge of the sleeve 34 in a watertight relationship.

The switch 35 is conventional and is capable of actuating the vibrator unit 24 alone, the heater 18 alone, or both the vibrator and the heater according to the rotary position of the knob 37. The switch is served by a conventional extension cord 40 and supplies power to the vibrator 24 and the heater 18 via wires 41 and 42, respectively.

As detailed in FIG. 6, the unit is supported on a plurality of foot mounts 43 which are engaged in leg bosses 44 extended from the bottom of the unit and positioned outboard of the coupling bosses 28, 28' and 29, 29' the mounts 43 include stepped, circular walls 45 and 46. The inner walls 45 are recessed from the ends 47 of the outer walls 46 and have a bore 48 therein for receiving a fastener such as a screw 49. The ends of the outer walls 46 are chamfered or rounded, as at 50, adjacent the surface of the mounts 43. The mounts 43 are formed of a resilient material such as a rubber or a synthetic and are inherently flat when in a relaxed condition before assembly with the bosses 44. Preferably, the mounts are perforated by a vent 51 to avoid a suction-cup effect when they are distorted into their generally conical, service configuration by the screw 49 and the outer wall 46. Also, it is preferred that washer 52 be interposed between the screw 49 and the surface of the mount 43.

The mounts 43 are augmented, in cases of extreme load as may occur if a user stands up in the bath, by a plurality of depending ribs 53 which are integral with the bottom of the decks 2 and 3 and which are normally spaced a slight distance from the surface on which the unit rests. If overloaded, the consequent flexing or distortion of the deck areas is kept within safe limits by engagement of the depending ribs with the underlying surface.

The foot-treating unit includes a cover member 54 which is secured against a flange 55 surrounding the upper edge of the base member 1 by a plurality of screws 56 with a permanent sealant interposed therebetween to provide a watertight seal about the periphery. The cover member 54 includes a wall portion 57 abutting a rear wall 58 in the pylon 23 and which may be secured thereto such as by an adhesive. Flanking the wall portion 57 and surrounding the access opening adjacent the front wall 5, the cover has a rolled or reversed lip 59 which reinforces the structure and serves to guard against splashing of the contents while the unit is being handled or used. At its front corners, the lip 59 is provided with a pair of drain slots 60 and 60' to prevent trapping of a portion of the water when the unit is to be emptied.

In order to facilitate secure handling and transport of the unit when it is filled, a plurality of ridges 61 are provided at convenient points on the underside of the flange 55. For ease of storage of the unit in a minimum of floor space, a pair of brace ribs 62 and 62' are extended from the rear end walls 8 and 9, respectively.

In a production of the unit, it is most advantageous to mold the base member as an integral unit including the decks, walls, tunnel, pylon, ridges and the several bosses and similar structure of the lower unit. The bottom side of the tunnel is closed, after assembly of the electrical components, by a bottom cover 63 which extends along the bottom and upwardly between the end walls 8 and 9, stopping short of the flange 55 to provide an access aperture 64 for storage of the cord 40 within the tunnel 4.

OPERATION OF THE PREFERRED EMBODIMENT

In use, the unit may be filled from any convenient source and then carried by the lip 59, with the unit having its rear portion extending downwardly and with the liquid securely confined between the base unit, cover and tunnel. At the point of use, the unit is then placed in the position shown in FIG. 1 and the cord 40 plugged into a suitable source of power.

A person may then place one or both feet in and onto the deck area and select the desired treatment function. It is preferable that the person being so treated be in a sitting position before the unit to obtain maximum benefit therefrom.

If the selected function is that of maintaining an elevated temperature in the bath solution, the heater is actuated and supplies heat to the bath via the cup or can 13. The exposed sidewall 21 of the can provides a substantial area for heat transfer to the bath, in addition to the primary transfer surface of the endwall 19. The bath is free to circulate between the cup 13 and the ridges 12 of the grill and to pass therefrom into the zones occupied by the feet.

If the selected function is that of massage, the vibrator unit is actuated and imparts vibration and torsion to the deck areas 2 and 3 against which the feet are placed. The relatively long lever arm provided between the axis of the eccentric-weight member and the coupling point extended beneath the area of the foot on the deck, in conjunction with the flexing ability of the foot-deck itself, provides a peculiarly effective and refreshing agitation of the feet.

During rotation of the eccentric, the inertia of the weight tends to "throw" outwardly from the axis of rotation and, consequently, to so displace the rotor casing. Since the rotor casing is mounted upon a moderately flexible base, in the form of the decks 2 and 3, and is extended therefrom by the frame 27 and the arms 25 and 26, this throwing action results in a multidirectional vibration and a torsional flexing of the deck areas on an axis generally transverse to the length of the foot. The action of the decks thus exceeds simple vibration and imparts a rocking action to the feet which is compatible with the primary axis of rotation of the ankle.

Accordingly, the effect of the new massaging unit is that of both vibrational treatment and flexing of the feet and ankle, either with or without the added effect of a warmed bath, and is in proximity to the flexing and kneading effect which would be experienced in actual manual massage, while retaining the soothing effect of simple vibration.

The mounts provided by the present invention are particularly effective in accommodating the compound action of the new unit. As best shown in FIG. 7, the mounts provide frictional areas which increase with increased loading of the unit. Therefore, if the unit is empty of liquid, the conically stressed mounts assume the position shown in solid lines in FIG. 6 and engage a surface area represented between the solid circles of FIG. 7. When the unit is filled with water, however, the stressed mounts are forced to flex further toward the position shown in the dotted line in FIG. 6 and to engage a greater surface area as represented between the dotted circles of FIG. 7. Also, the support 43 engages the underlying surface at a reduced radius to increase its spring gradient. Venting of the mounts via the vents 51 prevents the suction-adherence of the mounts against a supporting surface and the resultant difficulty in moving the unit after use.

Therefore, it is apparent that the massager and foot bathing unit of the present invention provides an especially effective massaging action, with the option of a simultaneous warm bath and without concern for electrical problems or dangers as a result of the presence of water in the bath. The pylon and the remainder of the tunnel structure preclude splashing or dripping of the bath solution into the area in which the electrical components are isolated, whether the unit is kept in a horizontal position or is carried in a position in which the bath flows to the rear end of the unit.

Various changes may be made in details of the invention as it is disclosed without sacrificing the advantages thereof or departing from the scope of the appended claims.

What is claimed is:

1. A foot treating unit comprising a. a housing including b. a pair of deck areas having top and bottom surfaces wherein feet are received on the top surfaces, and c. massaging means for massaging feet on said deck areas by multi-directional vibration of said deck areas wherein the massaging means includes a vibrator mounted on a centrally located deck coupling means for oscillation on an axis generally transversely of the deck areas and wherein said vibrator is positioned above the top surfaces of said deck areas and is coupled to said deck areas beneath the bottom surfaces of the deck areas.

2. The foot treating unit of claim 1 in which said housing includes a tunnel intermediate said deck areas and said vibrator is positioned within said tunnel.

3. The foot treating unit of claim 2 in which said housing includes walls about said deck areas and positioned to form with said tunnel a U-shaped bath zone above said deck areas.

4. The foot treating unit of claim 3 in which said tunnel includes a raised portion extended above the level of said bath zone, and an electrical switch on said raised portion and sealing means about said electrical switch.

5. The foot treating unit of claim 3 and including heating means in said bath zone.

6. The foot treating unit of claim 5 in which said heating means includes a heater element in the base let of said U-shaped bath zone, said heater element includes a metallic heat exchange surface exposed to the bath zone, and a grille adjacent and spaced from said metallic surface.

7. The foot treating unit of claim 6 in which said tunnel includes a lowered portion underlying the base leg of said U-shaped bath zone, an aperture in said lowered portion, said metallic heat exchange surface is exposed to the bath through said aperture, and sealing means between said aperture and said heater element.

8. The foot treating unit of claim 1 wherein the vibrator includes an unbalanced rotor and an armature, wherein the armature is mounted on pairs of arms which rigidly project upwardly from a beam positioned beneath the deck areas and is connected to the deck areas by coupling means located beneath where the feet are received, so as to localize the application of vibrations.

9. The foot treating unit of claim 1 further including means for supporting the unit in spaced relation to a surface wherein said supporting means are positioned outboard of said coupling means so that said vibrations are localized in the deck areas.

10. A foot treating unit comprising:

a housing defining an enclosed area for containing liquid, said housing having a bottom which includes a pair of deck areas, each of which has a top surface for receiving a foot thereupon and a bottom surface;

a hollow pylon extending above said deck areas;

centrally located coupling means positioned below said deck areas and secured to the bottom surface of said areas, said coupling means including arm means projecting above said deck areas;

vibration generating means attached to said arm means at a location above said deck area to drive said coupling means to vibrate said deck areas directly so as to localize vibrations therein; and means for supporting said deck areas at locations outboard of said coupling means.

11. The foot treating unit of claim 10 wherein the vibration generating means is an electric motor which includes an armature and unbalanced rotor, the motor is connected adjacent opposite ends thereof to the arm means with the rotor positioned above the point of connection of the arm means of the motor.

12. The foot treating unit of claim 10 wherein said pylon includes an electrical switch in the top region thereof.

13. The foot treating unit of claim 12 wherein heating means are disposed in said bottom adjacent to said pylon and between said deck areas, wherein said heater element includes a metallic heat exchange surface exposed to the bath zone and a grille disposed adjacent to and in spaced relation to said metallic surface to prevent direct contact between a foot and the metallic surface.

* * * * *

UNITED STATES PATENT OFFICE

CERTIFICATE OF CORRECTION

Patent No. 4,057,053 Dated November 8, 1977

Inventor(s) RAYMOND W. KUNZ

It is certified that error appears in the above-identified patent and that said Letters Patent are hereby corrected as shown below:

Claim 6, line 2, delete "let", insert --leg--.

Claim 9, line 1, delete "claim 1", insert --claim 8--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*